United States Patent [19]

Stoppazzini

[11] Patent Number: 4,667,488

[45] Date of Patent: May 26, 1987

[54] DEVICE FOR THE SELECTION OF THE SINKER AND NEEDLE ASSEMBLIES OF AN AUTOMATIC FLAT KNITTING MACHINE

[75] Inventor: Benito Stoppazzini, Sala Bolognese, Italy

[73] Assignee: E.M.M. Emiliana Macchine Maglieria S.R.L., Bologna, Italy

[21] Appl. No.: 895,684

[22] Filed: Aug. 12, 1986

[30] Foreign Application Priority Data

Sep. 18, 1985 [IT] Italy ..... 3550 A/85

[51] Int. Cl.[4] ..... D04B 7/00

[52] U.S. Cl. ..... 66/75.1; 66/75.2

[58] Field of Search ..... 66/75.1, 75.2, 78, 70, 66/73

[56] References Cited

U.S. PATENT DOCUMENTS 4,294,085 10/1981 Trautner ..... 66/75.1

4,490,994 1/1985 Essig ..... 66/75.1

4,571,955 2/1986 Stoppazzini ..... 66/75.1

*Primary Examiner*—Ronald Feldbaum

*Attorney, Agent, or Firm*—Stevens, Davis, Miller & Mosher

[57] ABSTRACT

A device made in a carriage of an automatic flat knitting machine, consists of a plurality of identical consecutive units 100, each of which is located between a plane of symmetry of two groups of movable cams and a plane of symmetry of two first fixed cams designed to select sinkers arranged in the bottom middle section of as many slots made in a needle beds; in each slot there is a needle above the sinker.

Each unit is made up of fixed and movable cams which operate in combination with the groups of cams and the first fixed cams to make plain stitches, and carryover stitches and to transfer and receive a stitch to and from another needle bed.

It is also possible to control the density of the fabric and carry out the "three-way technique" using a first row of needles which make the plain stitch, a second row of needles which make the carryover stitch and a third row of needles kept in rest position.

8 Claims, 18 Drawing Figures

FIG. 2
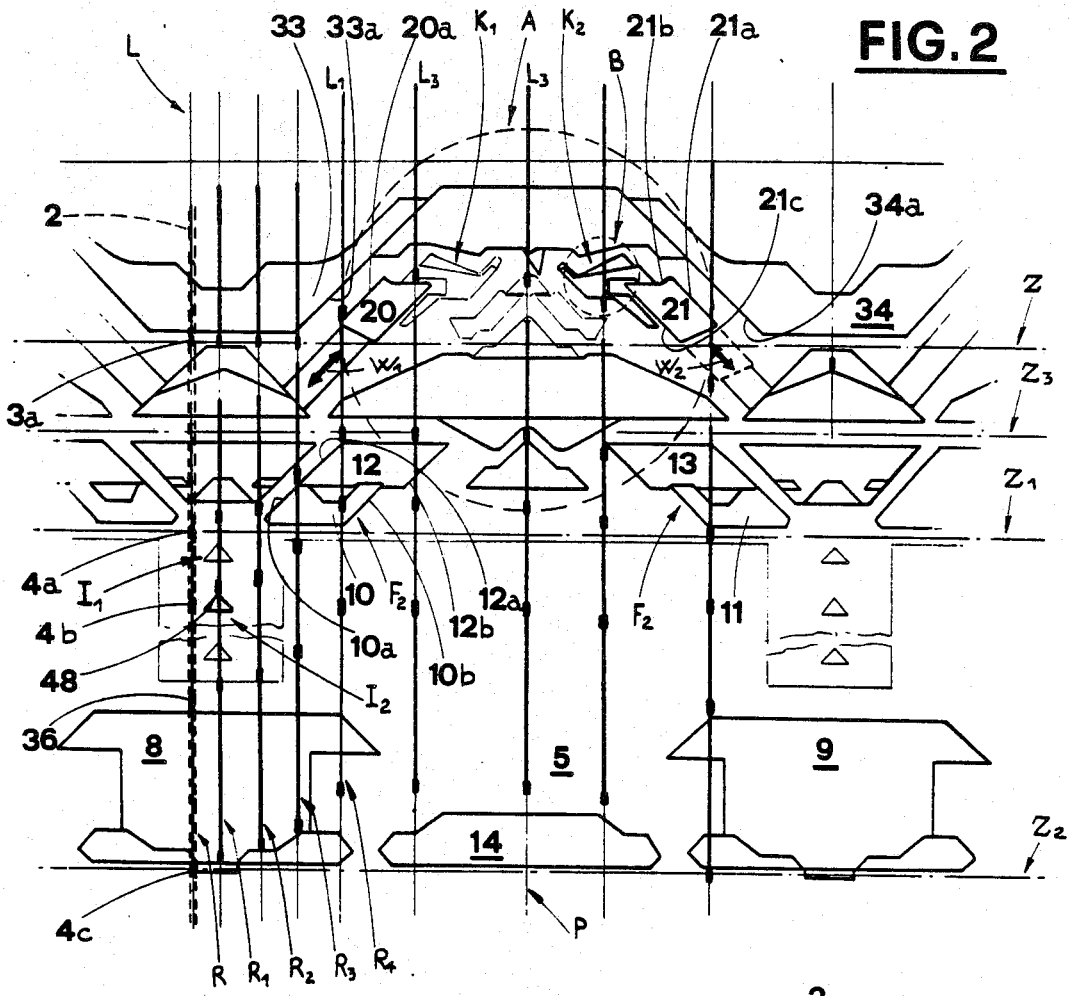
FIG. 1
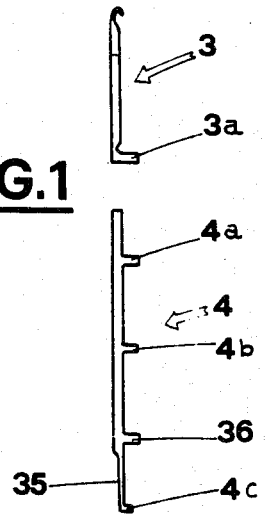
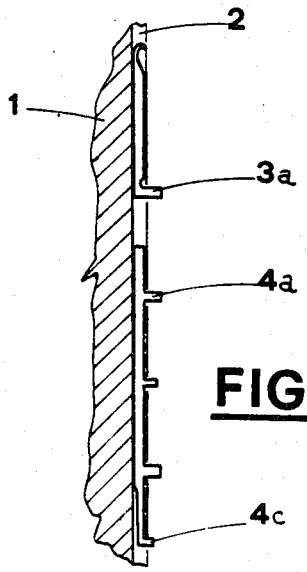
FIG. 1a

FIG. 2a
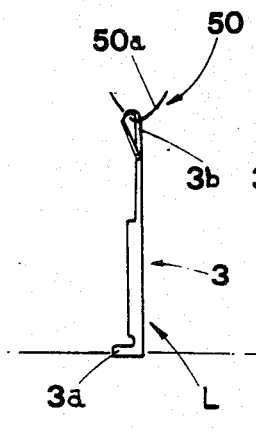
FIG. 2b
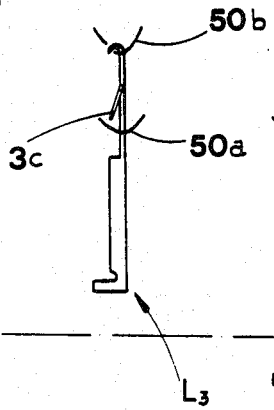
FIG. 2c
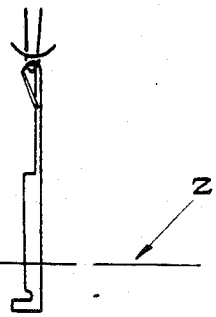
FIG. 5a
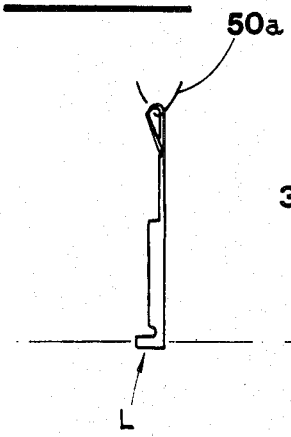
FIG. 5b
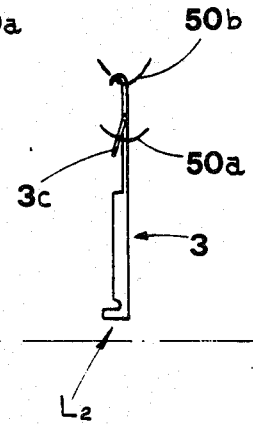
FIG. 5c
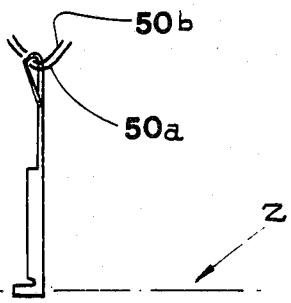
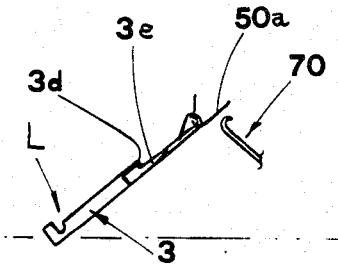
FIG. 3a
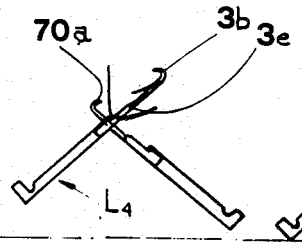
FIG. 3b
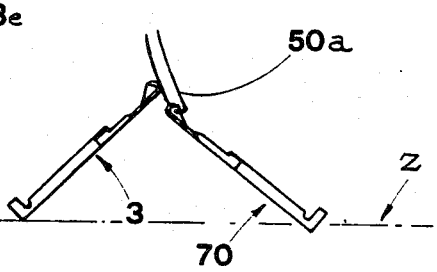
FIG. 3c

DEVICE FOR THE SELECTION OF THE SINKER AND NEEDLE ASSEMBLIES OF AN AUTOMATIC FLAT KNITTING MACHINE

BACKGROUND OF THE INVENTION

The invention relates to a device for the selection of the sinker and needle assemblies of an automatic flat knitting machine.

DESCRIPTION OF THE PRIOR ART

It is known that the needle bed on an automatic flat knitting machine has equidistant slots in it that are perpendicular to the carriage's direction of travel.

In each slot, proceeding from top to bottom, in order, there are a needle, the heel of which projects from the plane of the needle bed, and a sinker.

Said sinker (see application EPO No. 85830017 filed in the name of the same Applicant) has three heels, first, second and third heel, respectively, all protruding from the needle bed and the third of which is joined to the body of the sinker by a spring extension.

The carriage has a number of cam assemblies for the selection of the sinkers, the said cam assemblies being movable from an idle to a work position, at which work position the movable cam strikes against the second heel of corresponding sinkers. The striking of the cam causes the sinker to rise from rest position to a first intermediate position.

The selection of the sinker is completed (second phase) by a fixed cam located under the movable cam assembly that performed the first phase of the selection (the novel shape of the said cam assembly is described in the aforementioned patent application No. 85830017) which strikes against the third heel and thus causes the sinker to rise from the first to a second intermediate position.

While the sinker is in the aforementioned second position, a group of fixed cams, located symmetrically about two groups of movable cams, comes into contact with another heel made on the sinker between the second and third heels, in such a manner as to raise the sinker from the second intermediate position to its topmost position and then back to rest position.

The upward movement of the sinker just described has the effect of raising the corresponding needle which is consequently actuated.

At this stage, a series of cams, located above two of the aforementioned consecutive groups of movable cams, comes into contact with the heels of the needles that have been actuated so as to enable the needles to perform such well known operations as plain stitch, carryover stitch, transfer of a stitch to the other needle bed or reception of a stitch from the other needle bed. Moreover, a pair of movable cams, or rather, the movable cam downstream of the carriage's direction of travel, controls the return stroke of the needle from the point where the knit stitch was made to a point beyond the needle rest position, and consequently controls the density of the fabric.

The stitching operation, as well as the transfer and reception of a stitch to and from another needle bed and the regulation of the fabric density are effected by several consecutive cam units, these units being arranged between two movable selection cam units.

The arrangement just described greatly complicates the design of the carriage and, on account of the longitudinal development of the aforementioned units, the number of needle and sinker selection assemblies that can be mounted on the carriage is limited by the maximum compatible length of the carriage, that is, by the forces involved.

SUMMARY OF THE INVENTION

The object of the invention is to propose a device for the selection of the needle and sinker assemblies of a flat knitting machine, consisting of several consecutive elementary units, each unit comprising fixed cams and movable cams that perform multiple functions making it possible, with a longitudinal development considerably smaller than made up to now in carriages performing some of the functions obtainable with the same unit, to obtain the plain stitch, the carryover stitch, the transfer and reception of the plain stitch to and from another needle bed, the regulation of fabric density, as well as the implementation of the three-way system defined as being a first row of needles that do the plain stitch, a second row of needles that do the carryover stitch and a third row of needles kept in rest position.

Another object of the invention is to propose a device, which besides doing the above, enables the machine it is mounted on to achieve high productivity and production speeds higher than those possible up to now using known systems.

Another object of the invention is to propose a device wherein the movable cams have extreme characteristic positions which makes it possible for them to be actuated by electromechanical means serving a "all or nothing" adjustment typical of commands set by a programmable or programmed computerized unit.

The above is achieved in accordance with the invention by means of a device for the selection of needle and sinker assemblies of an automatic flat knitting machine, the said machine comprising amongst other things, two flat needle beds inclined symmetrically about a longitudinal plane, each needle bed having on it equidistant slots with, in each slot, proceeding from top to bottom, in order, a needle, the heel of which projects from the plane of the needle bed, and a sinker equipped with three heels, first, second and third heel, respectively, all protruding from the needle bed; the said machine also comprising a carriage that slides back and forth longitudinally on the needle beds; this carriage comprising: at least two groups of movable sinker selection cams, the cams of each group being arranged in a vertical row such that, when they are in working position, they come into contact with the corresponding second heels on the sinker, causing the latter to rise from rest position to a first intermediate position; at least two first fixed cams for completing sinker selection, each cam being located under one of the aforementioned rows of movable cams and arranged symmetrically about the vertical plane of symmetry of the row itself, such that it comes into contact with the third heel on the selected sinkers and thus cause the sinkers to rise from the first to a second intermediate position; the said device being characterized in that it has a plurality of identical units, each comprising: two second cams, movable perpendicularly to the plane of the carriage from an idle position to a working position and vice versa, and arranged symmetrically about the vertical plane of symmetry of the said units, above and on the inward side of the units, the said movable cams, when they are in work position, striking against the first heel of the selected sinkers in such a manner that the cam upstream of the direction of travel of the carriage raises the sinkers from the second to a thrid intermediate position, while the cam downstream lowers the sinkers to their rest position; two third cams, fixed, above and correspondently in series with the second movable cams, in such a way that the third cam located upstream strikes against the first heel of the selected sinkers in the third intermediate position and thus raises the sinkers to topmost position, so as to move the associated needles from rest position to a first level, while the other third cam, located downstream, strikes against the first heel of the selected sinkers and lowers the said sinkers to a point between the second and third intermediate positions; a fourth cam, fixed located between the aforementioned first fixed cams, symmetrically arranged about the said plane and on the inward side of the aforementioned third fixed cams in such a way as to strike against the third heel of the selected sinkers in the second intermediate position and thus raise the sinkers to the aforementioned third intermediate position; a fixed fifth cam and a fixed sixth cam, the latter being under the former, both located between the two aforementioned third cams symmetrically about the said plane and jointly defining a race shaped like an overturned "V" with a guide at each end, the upstream guide being designed to convey the first heel of the selected sinkers that are in both the topmost and the aforementioned third intermediate position, while the downstream guide is designed to convey the aforementioned first heel towards the aforementioned third fixed downstream cam, the said race being such that the needles that are in rest position move up by means of the sinkers from rest position to a second level, higher than the aforementioned first level, where the needles can receive the knit stitches from another needle bed or load the stitches; two fixed seventh cams, located correspondently above the aforementioned groups of movable cams, symmetrically about the planes of symmetry of the said movable cams, in such a way that they strike against the heels of the needles below rest position and thus define the rest position of the heels; two eigth cams that, when at rest, are located above te longitudinal line defined by the needle heels in the rest position, the said cams being movable in two corresponding inclined planes making an overturned "V" symmetrical about the said vertical plane of symmetry, the eighth cam located upstream being kept in rest position so as to strike against the heel of the needles that are situated at the aforementioned first level in such a manner as to raise the needles to a third level, higher than the second level, where the knit stitch is made, while the eighth cam downstream strikes against the heels of the needles that are being lowered and drops lower than the rest position of the needles, in such a manner as to control the density of the fabric; two ninth cams that move, perpendicularly to the plane of the carriage, from an idle position to a work position and vice versa, the same cams being symmetrical about the said plane of symmetry and located above and correspondently in series in relation to the aforementioned eighth cams, such that the ninth cam that is upstream, when it is in work position, strikes against the heel of the needles located at the aforementioned third level and raises the needles to a fourth level where the knit stitch can be transferred to another needle bed, and such that the ninth cam that is downstream is kept permanently in work position and not only operates in combination with a tenth cam, that is pivoted about an axis perpendicular to the plane of the carriage and co-planar with the said plane of symmetry, to transfer the heels of the needles located at the aforementioned fourth level towards the downstream eighth cam, but also operates to convey towards the said eighth cam the heels of the needles located at the third level; an eleventh cam, that moves perpendicularly to the plane of the carriage from an idle position to a work position and vice versa, this eleventh cam being centred in relation to the said plane of symmetry and operates, when it is in work position, to strike against the needle heels that are in rest position in such a manenr as to raise the latter to the aforementioned second level. two twelfth cams, that move perpendicularly to the plane of the carriage from an idle position to a work position, located on either side of the aforementioned eleventh cam, the twelfth cam that is upstream, when it is in work position, operating to guide the needle heels while the latter are lifted, either by the aforementioned fifth and sixth cams or by the aforementioned eleventh cam, from rest position to the said second level, while the twelfth cam that is downstream, when it is in work position, strikes against the needle heels in such a manner as to move them from the second level to the relative rest position; two fixed thirteenth cams, located correspondently above the said groups of cams symmetrically about the planes of symmetry of the said groups and below the aforementioned seventh cams, each of the said thirteenth cams being designed to strike against the first heel of the sinkers that are located between the aforementioned second and third intermediate positions and selected by the group of cams located upstream of the said thirteenth cam, in such a manner as to raise the said sinkers to the third intermediate position.

BRIEF DESCRIPTION OF THE INVENTION

The characteristics of the invention that do not emerge from what has been stated above, are discussed hereinafter with reference to the attached set of drawings, in which:

FIG. 1 is a side view of a sinker and needle assembly, while FIG. 1*a* illustrates the said assembly inserted in a slot of the needle bed;

FIG. 2 diagrammatically illustrates the configuration with which the knit stitch is carried out, while FIGS. 2*a*, 2*b* and 2*c* diagrammaticaly illustrate the development by which the stitch is carried out;

FIG. 3 diagrammatically illustrates detail A of FIG. 2 which is the configuration with which the knit stitch is transferred to another needle bed, while FIGS. 3*a*, 3*b* and 3*c* diagrammatically illustrate how the transfer takes place;

FIG. 4 diagrammatically illustrates the configuration with which a selected needle receives a knit stitch from another needle bed;

FIG. 5 diagrammatically illustrates detail C of FIG. 4 which shows how a carryover stitch is made by means of a selected needle, while FIGS. 5*a*, 5*b* and 5*c* diagrammatically illustrate the various steps in the formation of the carryover stitch;

FIGS. 6 and 7 diagrammatically illustrate detail C of FIG. 4 which shows how a knit stitch is received from another needle bed and carryover stitch formed by a non-selected needle;

FIG. 8 diagrammatically illustrates the configuration with which the three-way technique is carried out.

DESCRIPTION OF THE PREFERRED EMBODIMENT

Figure 4:
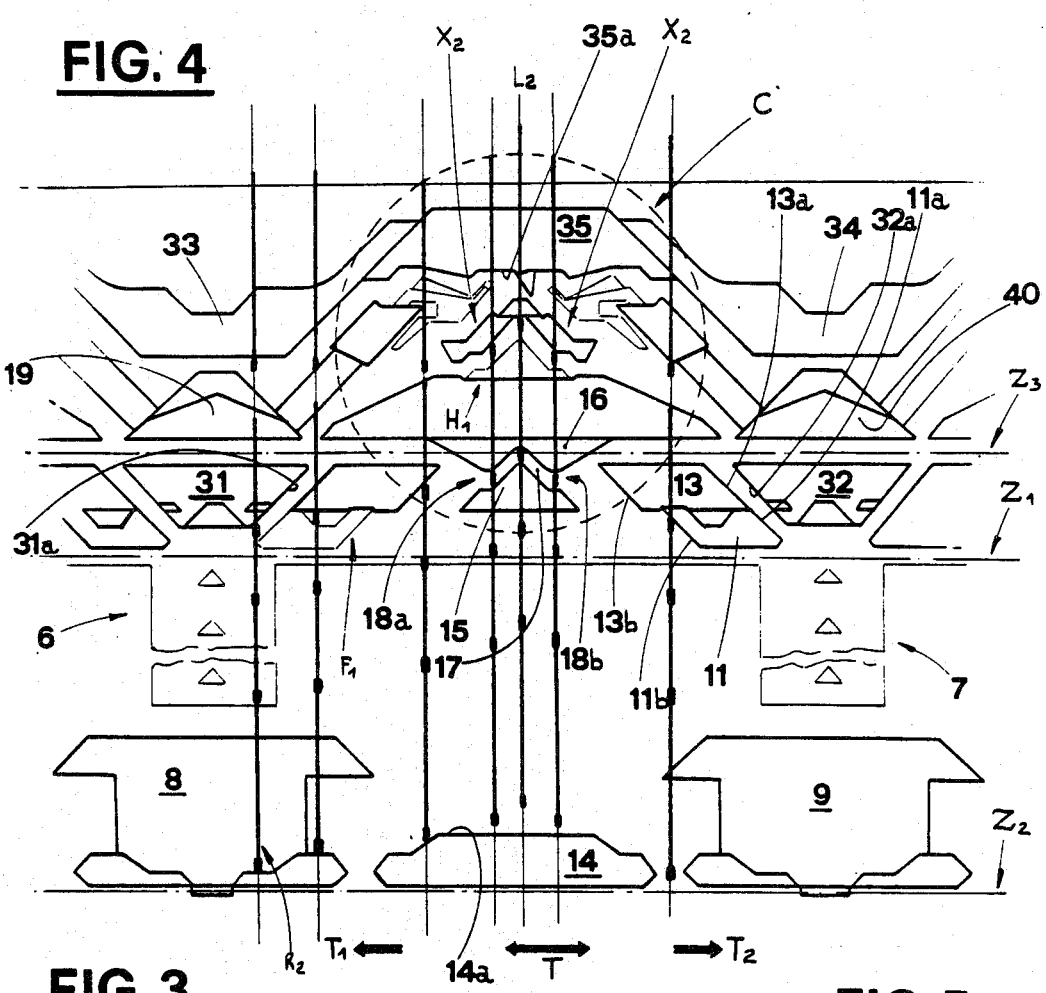

With reference to the above figures, 5 represents diagrammaticaly the carriage of a flat knitting machine running over two needle beds 1 (one of which is illustrated diagrammatically in FIG. 1, since it is a of known type) arranged at an angle to each other in such a way as to form an upturned "V", symmetrically about a longitudinal vertical plane; the needle bed has on it a set of equidistant slots 2 (one of which is shown by a dashed line in FIG. 2) that are perpendicular to the direction of travel T of the carriage; in each slot, proceeding from top to bottom in order, there are a needle 3 and a sinker 4.

The needle 3 has a heel 3*a;* the sinker 4 has three heels, 4*a,* 4*b* and 4*c,* first, second and third heel, respectively, the third of which is joined to the body of the sinker by a spring extension 35 (see patent application EPO No. 85830017 quoted in the introduction hereof); between the second and third heels there is another heel 36 that is integral with the body of the sinker.

All the said heels 3*a,* 4*a,* 4*b,* 4*c* and 36 protrude from the relative slot (FIG. 1*a*).

The device in question is made up of several consecutive units 100, that are all identical to each other: obviously, only one unit will be described here.

6 and 7 represent two groups of selecting cams 48 movable in a plane perpendicular to the plane of the carriage from an idle position I1 to a work position I2; the cams 48 of each group are arranged in a vertical row and each cam 48, when it is in work position I2, strikes against the second heel 4*b* of corresponding sinkers 4: the striking of the cam causes the sinker to rise from rest position R to a first intermediate position (first phase of selection).

The selection of the sinker is completed (second phase) when a first fixed cam 8,9 (located under the corresponding group 6, 7 and symmetrical about the vertical plane of symmetry of the corresponding group) strikes against the third heel 4*c;* the shape of the first fixed cam and the way in which the sinker rises from the first intermediate position R1 to a second intermediate position R2 as a result of the cam striking against it are not described here since they are the object of patent application EPO No. 85830017 by the same Applicant.

The sinker is selected when it is in the second intermediate position R2, at which point it has not yet struck the associated needle 3.

When the sinker is in rest position R, the associated first heel 4*a,* runs along trajectory Z1 as a result of the motion of the carriage.

Above the said line, on the inner side of the two aforementioned groups 6 and 7, there are two second cams, 10 and 11, that move from an idle position F1 to a work position F2, in a plane perpendicular to the plane of the carriage and that are arranged symmetrically about the vertical plane of symmetry P of the aforementioned groups 6 and 7.

The outer faces 10*a,* 11*a* and inner faces 10*b* and 11*b* of the said cams are flat and diverge from the said plane P from the top down.

Corresponding third fixed cams 12 and 13 are arranged in series with the said second cams 10 and 11. The outer faces 12*a* and 13*a* of the said third cams are co-planar with the corresponding outer faces 10*a* and 11*a* of the second cams. The inner faces 12*b* and 13*b* of the third cams are inclined similarly to the inner faces of 10*b* and 11*b* of the second cams, but further in than the latter.

The inner faces 31*a* and 32*a* of two fixed cams 31 and 32 are located opposite the aforementioned pairs of outer faces 10*a*–12*a* and 11*a*–13*a* and set at the same angle as the latter.

The terms "upstream" and "downstream" shall hereinafter refer to the direction of travel T1 of the carriage.

When it is in work position F2, the second cam 10 upstream is such that it strikes with its outer face 10*a* against the first heel 4*a* of sinkers 4 that are located in the second intermediate position R2. This raises the sinkers to a third intermediate position R3 at which the sinkers still do not come into contact with the associated needles.

The first heel 4*a* of the sinkers that are located in the third position R3 is struck by the outer face 12*a* of the third cam 12 situated upstream. This raises the sinkers to topmost position R4 which in turn raises the corresponding needles from rest position L to a first level L1.

As the sinker rises as a result of its first heel 4*a* having been struck by the outer faces 10*a* and 12*a,* the opposite face 31*a* of the fixed cam 31 acts as guide for the said fist heel 4*a.*

The function of the inner faces 11*b* and 13*b* of the downstream cams 11 and 13 will be described later.

A fourth fixed cam 14 is located at point between the first fixed cams 8 and 9 symmetrically about the aforementioned plate P and above the trajectory Z2 made by the third heel 4*c* when the associated sinker is in rest position R.

The top face 14*a* of the latter cam 14 is such as to engage with the third heel 4*c* of the selected sinkers 4 (i.e. those in the second intermediate position R2) only when the second cam 10 upstream is in idle position F1. This raises the sinker from the second to the third intermediate position R3.

A fifth and a sixth cam, 16 and 15, both fixed, and symmetrical about the aforementioned plane P, are located between the aforementioned third cams 12 and 13. The sixth cam 15 is located under the fifth cam 16.

The said cams 16 and 15 jointly define a race 17 shaped like an overturned "V" with guides 18*a* and 18*b* at each end; the upstream guide 18*a* conveys into the race 17 the first heel 4*a* of the selected sinker that are in both the topmost position R4 (due to the action of cams 10 and 12) and the third intermediate position R3 (due to the action of cam 14); the same race causes the sinker in question to effect an oscillating movement, first upwards and then downwards, in such a manner as to push the corresponding needle 3, but only if the latter is in rest position 1, up to a second level L2 that is higher than the aforementioned first level.

The guide 18*b* at the downstream end of the race 17 conveys the first heel 4*a* towards the inner face 13*b* of the cam 13. After being engaged by the inner face 13*b,* the heel 4*a* engages with the inner face 11*b* of the second cam 11 downstream (if the said cam 11 is in work position F2) which brings the sinker 4 back to rest position R. On the other hand, if the downstream cam 11 is in idle position F1, the sinker 4, after the heel 4*a* has been engaged by the inner cam face 13*b,* is moved to a point R between the aforementioned second and third intermediate positions R2 and R3.

Above the aforementioned fixed cams 31 and 32 and above the trajectory Z3 made by the first heels 4*a* of the selected sinkers at the topmost position R4, there are two seventh cams 19 and 40, both fixed and each arranged symmetrically about the vertical plane of symmetry of the corresponding groups 6 and 7. Cams 19 and 40 are designed to engage with the heels 3*a* of the needles located below the rest position L so as to take the heels 3*a* back to the trajectory Z they make when in rest position.

Two eighth cams 20 and 21 are located, when at rest, above the said trajectory Z and move in corresponding sloping lines W1 and W2 which form an upturned "V" that is symmetrical about the aforementioned plane of symmetry P.

The upstream eighth cam 20 is always at rest and is positioned in such a manner as to strike against the heel 3*a* of the needles located at the aforementioned first level L1. As a result of striking with its heel 3*a* against the cam 20, the needle is raised to a level L3 that is higher than the second level L2.

The inner faces 33*a* and 34*a* of two fixed cams 33 and 34 are located opposite to, and at the same angle as, the outer faces 20*a* and 21*a* of the eighth cams. The inner face 33*a* of the upstream fixed cam 33 serves as a guide for the heel 3*a* engaged by outer face 20*a* of the upstream eighth cam 20.

The downstream eighth cam 21 can be lowered (by known means that are not illustrated) to a point below its rest position. In this case, the associated inner face 21*c* strikes against the heel of the selected needles (the heel is guided towards it by other cams described later) thus causing the heel in question to drop below line Z: the seventh downstream cam 40 carries the heel back to line Z.

Two ninth cams 22 and 23 that move in a plane perpendicular to the plane of the carriage from an idle position K1 to a work position K2 are arranged correspondently above the eighth cams 20 and 21 and symmetrically about the said plane P. The outer faces 22*a* and 23*a* (when the cams are in work position X2) are inside the concave portions 20*b* and 21*b* made in the top face of the corresponding eighth cams 20 and 21. It is stressed that the eighth cams never interfere with the said ninth cams since the former never rise above their rest position.

The downstream ninth cam 23 is always in work position K2. In this position, its inner face 23a strikes against the heel 3*a* of the needles that are at the third level L3 and conveys the said heel towards the inner face 21*c* of the downstream eighth cam 21.

When it is in work position K2, the upstream ninth cam 22 strikes against the heel 3*a* of the needles that are at the said third level L3 in such a manner as to raise the needle in question to a fourth level L4. In this latter position, the heel 3*a* "runs along" a concavity 22*a* made in the top face of cam 22.

The downstram ninth cam 23 also has a concavity 23*a* in its top face. The bottom face 35*a* of a fixed cam 35 lies opposite the top face of the ninth cams 22 and 34, the profile of which it follows, in such a manner as to serve as a guide for the heel 3*a* of the needles located at the fourth level L4.

A tenth fixed cam 24, pivoted about an axis perpendicular to the plane of the carriage and co-planar with the aforementioned plane of symmetry P, engages wih the heel 3*a* of the needles located at the fourth level L4, guiding the heel in question towards the inner face 23*c* of the downstream ninth cam 23, the said cam being, as we saw earlier, in work position K2.

On trajectory Z made by the heels of the needles at rest, there is an eleventh cam 35, that moves in a plane perpendicular to the plane of the carriage from an idle position H1 to a work position H2 and that is symmetrical about the aforementioned plane of symmetry P.

When it is in work position H2, the said eleventh cam 25 engages with the heel 3*a* of the non-selected needles and raises the latter from their rest position to the aforementioned second level L2.

Above and on either side of the eleventh cam 25, there are two twelfth cams 26 and 27 that move perpendicularly to the plane of the carriage from an idle position X1 to a work position X2 and that are symmetrical about the aforementioned plane of symmetry P.

The twelfth cam 26 is designed to guide the needle heels 3*a* as the latter rise from rest position L to the aforementioned second level L2. As we saw earlier, the raising of the needle is effected by the eleventh cam 25 in work position H2 or by the fifth and sixth cams 16 and 15.

When it is in work position X2, the downstream twelfth cam 27 strikes against the heels 3*a* of the needles located at the aforementioned second level L2, in such a manner as to pull the needles down to rest position L.

When cams 26 and 27 are in work position X2, they make an upturned "V" which is identical in shape to race 17. The vertical distance between the said "V" and race 17 is equal to the distance between the needle heel 3*a* and the first heel on the sinker, when the needle and the sinker are in contact.

Above the aforementioned groups 6 and 7 and below the seventh cams 19 and 40, there are two thirteenth cams 28 and 29, each of which is symmetrical to the vertical axis of symmetry of the corresponding group.

The upstream thirteenth cam 28 strikes against the first heel 4*a* of the sinkers selected by cam assembly 6 which precedes assembly 6 when the carriage travels in direction T1. More precisely, when a sinker is selected in the unit 100*a* that comes first, the second cams 10 and 11 associated to the said unit 100*a* are both in idle position F1, as a result of which the sinker moves to point R between the second intermediate position R2 and the third R3.

It is precisely when the sinker is in position R that the upstream thirteenth cam 28 strikes against the first heel 4*a* on the sinker in such a manner as to raise the latter to the third position R3.

The various operations which can be carried out with this device shall now be detailed, without describing the means for actuating the movable cams, since these means are known. The said means are of the "all or nothing" type, since the cams assume characteristic idle or work extreme positions. This means they can be interfaced with a programmed or programmable computer unit.

The way in which a plain stitch is made is described hereinafter with reference to FIGS. 2, 2*a*, 2*b* and 2*c*.

The plain stitch is made when the second cams 10 and 11 are in work position F2, the upstream ninth cam 22 in idle position K1, the downstream ninth cam 23 in work position K2, the upstream eighth cam 20 at rest, and the downstream eighth cam below rest position (shown by a dashed line in FIG. 2) so as to define the desired density of the fabric.

In actual fact, it is the carrige that moves in direction T1, whereas in FIG. 2, the carriage has been assumed to be stationary and the sinker and needle assembly to be moving in direction T2, opposite to T1.

Initially, both the sinker 4 and the needle 3 are in rest position, i.e., R and L respectively. When cam 48 is at 12, corresponding to the second heel 4*b* of the sinker in question, the latter is moved to the first intermediate position R1. As we saw earlier, the sinker is moved to R2 by the first fixed cam 8.

Cams 10 and 12 now lift the sinker from R2 to R3 and then to topmost position R4. As it rises to the latter position, (that is from R3 to R4) the needle 3 is lifted to the aforementioned first level L1.

With that, the sinker has fulfilled its function. The first heel moves along a part of trajectory Z3, and then along a guide 18*a*, a race 17 and a guide 18*b* which conveys the heel towards the outer face 13*b* of cam 13, which conveys the same heel towards the outer face 11*b* of cam 11, which in turn takes the sinker back to start position.

While the movements just described are taking place, the needle heel 3*a* is raised, by the outer face 20*a* of cam 20, from the first level to the third L3. Except for a slight downward movement caused by the concavity 20*b*, the needle stays in this position until its heel 3*a* is engaged by inner face 23*c* of cam 23. This conveys the heel towards the inner face 21*c* of cam 21 (the cam used for regulating fabric density), which causes the needle to move beyond its rest position L (with heel 3*a* below line Z). The next cam, 40, carries the needle back to rest position L (heel 3*a* on line Z).

The formation of a plain stitch is illustrated schematically in FIGS. 2*a*, 2*b* and 2*c*.

In FIG. 2*a*, the needle is in rest position L. The hook 3*b* has on it a loop 50*a* of yarn 50. Latch 3*c* is closed.

In FIG. 2*b*, the needle is at the third level L3. The rising of the needle to level L3 has caused the loop 50*a* to open latch 3*c* and to settle at a point below the latch. FIG. 2*b* also shows another loop 50*b* being formed in hook 3*b* (through the use of known means that are not illustrated) in area B (FIG. 2).

In FIG. 2*c*, the needle has completed its downward movement (by means of cam 21) and has stopped beyond its rest position L. The lowering of the needle has caused the first loop to re-close latch 3*c*.

The twofold function of cams 20 and 21 is stressed. The outer face of the said cams raises the needle while the inner face completes the lowering of the needle and simultaneously controls the density of the fabric.

Figure 3:
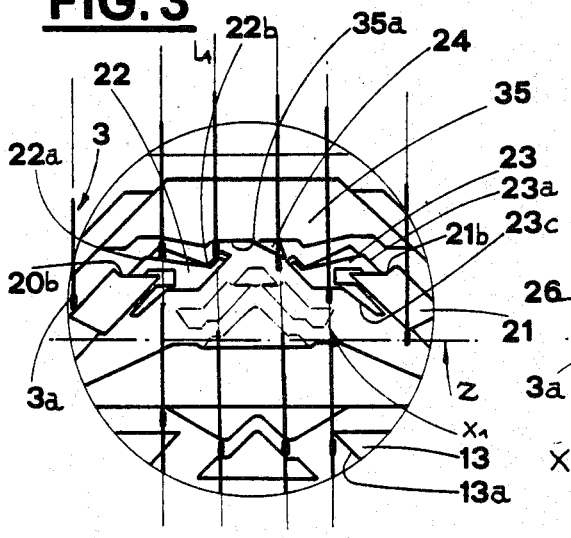

When the stitch is transferred to another needle bed (FIG. 3), the movable cams are all in the same position shown in FIG. 2, except for cam 22 which is in work position K2 and cam 21 which is at rest.

The above description also applies to sinker 4. Heel 3*a* of the needles located at the third level L3 is engaged by the outer face 22*b* of cam 22, thus raising the needle to the aforementioned fourth level L4.

Heel 3*a* then strikes against cam 24 causing the latter to turn about its axis and thus to form an extension of the inner face 23*c* of cam 23. Face 23*c* and the following adjacent inner face 21*c* of cam 21 take the heel back to rest position L.

The transfer of a plain stitch to another needle bed is illustrated schematically in FIGS. 3*a*, 3*b* and 3*c*.

In FIG. 3*a*, the needle is at rest and conditions are the same as in FIG. 2*a*.

In FIG. 3*b*, the needle is at the fourth level L4: the loop 50*a* is beyond the latch 3*c* in the proximity of a stop 3*d* on the body of the needle.

A spring plate 3*e*, connected to the body of the needle at the said stop, forms a seat 3*f* into which a needle 70 of the other needle bed is inserted, this other needle bed being opportunely offset in relation to the needle bed 1 associated to needle 3. The return of the needle 70 towards its rest position causes the loop 50*a* to latch on to the hook 70*a* of the needle 70.

The needle 70 is in the position that enables it to receive the stitch from the other needle bed. How the stitch is actually received is described hereinafter in relation to the unit 100 in question.

Figure 6:
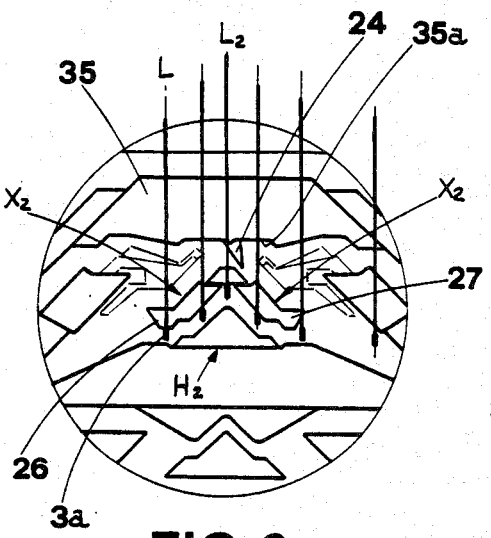

The above can be achieved by selecting the needle (FIG. 4) or with a non-selected needle (FIG. 6).

In the first case, cam 10 is in idle position F1, cam 11 in work position F2, cam 25 in idle position K1, cams 26 and 27 in work position X2 and cam 21 at rest. The other movable cams do not operate in this case.

The first heel 4*a* on the sinker located in position R2 is not engaged by cam 10. As we saw earlier, this means that the fixed cam 14 engages the third heel 4*c*, thus raising the sinker from R2 to R3 and enabling the first heel 4*a* to be "caught" by guide 18*a*.

In this way, the first heel 4*a*, engaged by cam 15, moves into race 17. The needle 3 is thus lifted to the aforementioned second level L2 (guided by the inner face of cam 26).

When it is at level L2, needle 3 is in the same condition as needle 70 shown in FIGS. 3*b* and 3*c*. When needle 3 is then lowered by striking with its heel 3*a* against the inner face of cam 27, it receives the stitch from the other needle bed.

Simultaneously with the operation just described, sinker 4 is carried back to rest position by means of cams 13 and 11.

The second way in which a plain stitch can be received from another needle bed is with non-selected needles (FIG. 6). In this case, sinker 4 is kept in rest position R, cam 25 is in work position H2 and both cams 26 and 27 are in work position X2.

The heel 3*a* of the needles that are in rest position R is engaged by the upstream face of cam 25. This causes the needle to rise to the second level L2, which enables needle 3, in combination with needle 70 of the other needle bed to receive the stitch from the latter.

As in the previous case, cam 27 carries the needles back to rest position L.

Figure 5:
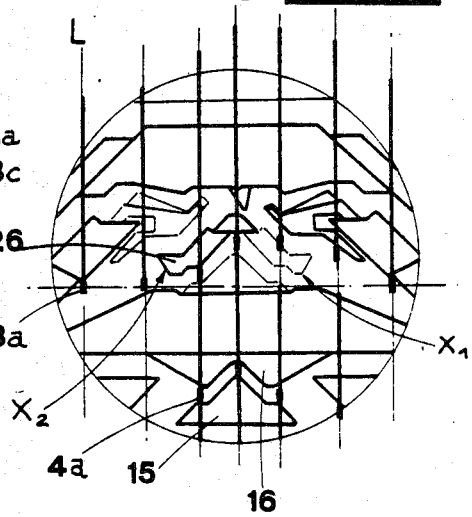
Figure 7:
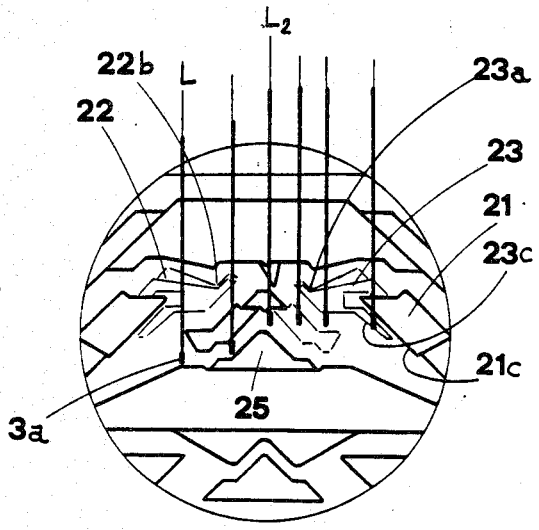

FIGS. 5 and 7 show the configuration with which the carryover stitch is formed, the former (FIG. 5) by means of a selected needle and the latter (FIG. 7) by means of a non-selected needle.

The configurations shown in FIGS. 5 and 7 differ from the configurations and operational situations shown in FIGS. 4 and 6 only in that cam 27 (the downstream one) is in idle position X1.

In both cases (FIG. 5 and FIG. 7), the needle 3 (whether selected or not), remains in the aforementioned second level L2 until it strikes with its heel 3*a* first against the inner face 23*c* of cam 23 and then against the inner face 21*c* and is thus returned to rest position L.

Obviously, while a stitch is being carried over (or loaded), the needles of the remaining needle bed do not in any way interfere with needles 3.

The formation of this type of stitch is illustrated in FIGS. 5*a*, 5*b* and 5*c*.

In FIG. 5*a*, the needle is at rest as in FIGS. 2*a* and 3*a*, described earlier.

In FIG. 5*b*, the needle is at the second level L2; the loop 50*a* "embraces" latch 3*c*.

In these conditions, the needle hook 3*b* cam make another loop (in which case, when the needle returns to rest position, hook 3*b* retains not only the previous loop 50*a* but also the second loop just formed), or it may not make a loop (in which case, when the needle returns to rest position, hook 3*b* retains only the previous loop 50*a*. In short, in both cases, the previous loop 50*a* never goes beyond latch 3*c*, which means it is retained (i.e. is not cast off) by hook 3*b*.

The configurations and means by which the device carries out the "three-way technique" are now described with reference to FIG. 8, the said technique being defined as being a first row of needles that do the plain stitch, a second row of needles that do the carryover stitch and a third row of needles kept in rest position.

The technique just mentioned can be carried out using two consecutive units, 100*a* and 100.

Figure 8:
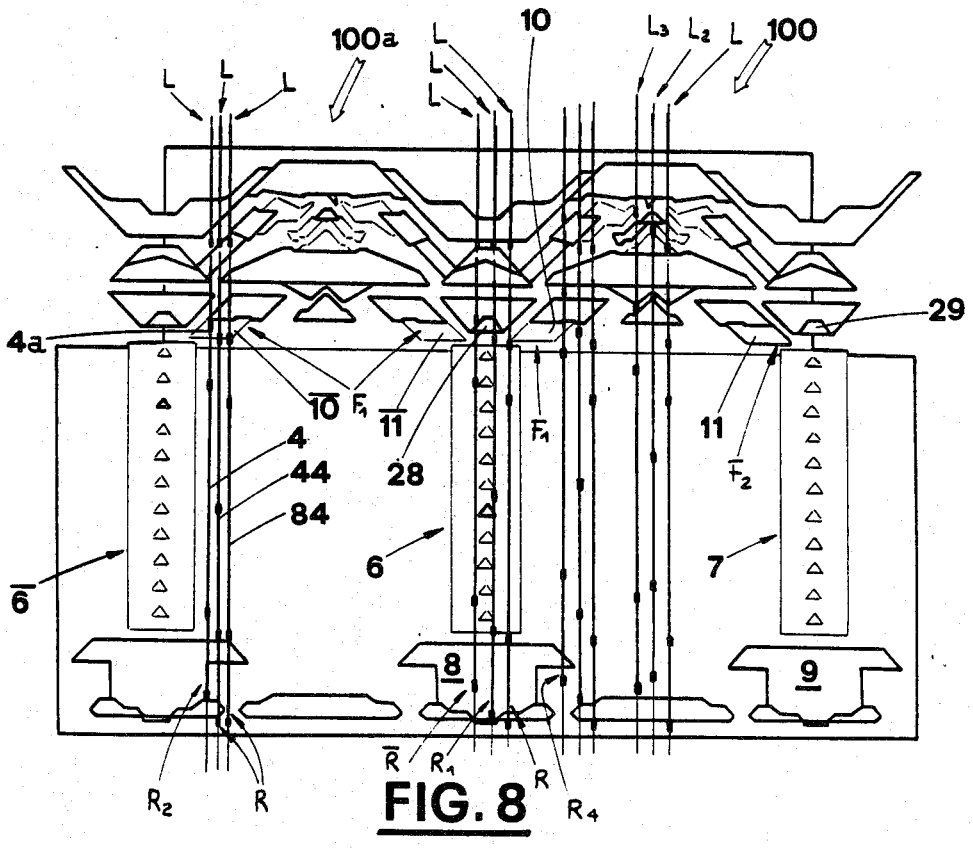

In FIG. 8, numbers 4, 44 and 84 represent three sinkers. Sinker 4 is selected by unit 6. Since cams 10 and 11 of unit 100*a* are in idle position F1, sinker 4, upstream of cam 28 associated to unit 6, is in position R at a point between the second intermediate position R2 and the third R3. The first heel 4*a* is thus engaged by cam 28 which moves the sinker 4 to third position R3. The outer face 12*a* of cam 12 lifts sinker 4 as far as R4, which has the effect of lifting the needle associated to it as well, and consequently, of forming the plain stitch (obviously, cam 22 is in idle position K1).

Sinker 44 is not selected by unit 6 but by unit 6. Cam 10 is in idle position F1, (while cam 11 is in work position F2), which means that sinker 44 is lifted to R3 by cam 14 and then raised further by the two cams 15 and 16. The needle associated to sinker 44 forms a carryover stitch since cam 26 is in work position X2, while cam 27 is in idle position X1 (obviously, cam 25 is in position K1).

Sinker 84 is not selected by either unit 6 or 6 and so the needle associated to it remains at rest even during the sequence described above (cam 25 in position K1).

In conclusion, unit 100 makes it possible to carry out all the operations required to make the fabric. Moreover, the fact that one cam fulfils several functions, combined with the special shape and positioning of the fixed and movable cams in relation to each other, has made it possible to make the device considerably shorter than the known devices used to perform the same or similar functions.

The advantage just mentioned means that many more consecutive units of this kind can be mounted on the carriage than has been possible to date with units of the known kind.

It should also be stressed that two consecutive units of this kind, 100*a* and 100 can be used to carry out the so-called "three-way technique". Finally, it is also stressed that the movable cams assume characteristic extreme positions, which enables the control units of the devices can be interfaces with a computerized system.

The fabric density control cams 20 and 21 are an exception. In fact, downstream cam 21 is moved downwards in successive steps through known means, actuated by a stepping motor which can be interfaced with a computerized system. The said means and motor are not illustrated since they are not pertinent to the invention.

It is understood that the description given herein is purely an unlimited example and thus that eventual variations in the constructional details that tend to achieve the same results all fall within the framework of protection afforded to the invention as claimed hereinafter.

What is claimed is:

1. A device for the selection of sinker and needle assemblies of an automatic flat knitting machine, this latter comprising, amongst other things: two flat needle beds, inclined symmetrically about a longitudinal plane, each needle bed having on its equidistant slots with, in each slot, proceeding from top to bottom, in order, a needle, with a heel projecting from the plane of said needle bed, and a sinker equipped with at least three heels, first, second and third heel, respectively, all protruding from said needle bed; and a carriage that slides back and forth longitudinally on said needle beds, with said carriage comprising: at least two groups of movable sinker selection cams, the cams of each group being arranged in a vertical row such that, when they are in work position, they come into contact with said second heels on the sinker, causing the latter to rise from rest position to a first intermediate position; at least two first fixed cams for completing sinker selection, each cam being located under one of said rows of movable cams and arranged symmetrically about a vertical plane of symmetry of said row, such that it comes into contact with said third heel on the selected sinkers thus causing the sinkers to rise from the first to a second intermediate position; said device having a plurality of identical units, with each of said units comprising: two second cams, movable perpendicularly to the related inner surface of said carriage from an idle position to a work position and vice versa, and arranged symmetrically about a vertical plane of symmetry of said two groups of cams, above and on the inward side of these letter groups, said movable cams, when they are in work position, striking against said first heel of said selected sinkers in such a manner that the cam located upstream in respect of the direction of travel of said carriage raises the sinkers from the second to a third intermediate position, while the remainder of said second cams, located downstream of the former, lowers said sinkers to their rest position; two third cams, fixed, situated above and correspondently in series with said second movable cams, in such a way that said third cam located upstream strikes against said first heel of said selected sinkers in the third intermediate position, thus raising said sinkers to topmost position, so as to move the associated needles from a rest position to a first level, while the other third cam, located downstream, strikes against said first heel of said selected sinkers and lowers said sinkers to a point located between their said second and third intermediate positions; a fourth cam, fixed, located between said first fixed cams, symmetrically arranged about said vertical plane of symmetry of said two groups of cams and on the inward side of said third fixed cams in such a way as to strike against said third heel of said selected sinkers in the second intermediate position thus raising said sinkers to said third intermediate position; a fixed fifth cam and a fixed sixth cam, the latter being under the former, both located between said two third cam symmetrically about said vertical plane of symmetry of said two groups of cams, and jointly defining a race shaped like an overturned "V" with a guide at each end, the upstream guide being designed to convey into said race said first heel of said selected sinkers that are in both said topmost position and said third intermediate position, while the downstream guide is designed to convey said first heel towards said third fixed downstream cam, said race being such that said needles that are in said rest position move up by means of said sinkers from rest position to a second level, higher than said first level, where said needles of one said needle bed can receive a knit stitches from the other needle bed or load a stitches; two fixed seventh cams, located correspondently above said groups of movable cams symmetrically about said plane of symmetry of said groups, in such a way that they strike against said heels of said needles below rest position thus defining a rest position for the heels themselves; two eighth cams that, when at rest, are located above a longitudinal line defined by said heels of said needles in the rest position, said cams being movable in two corresponding inclined planes making an overturned "V" symmetrical about said vertical plane of symmetry of said two groups of cams, the eighth cam located upstream being kept in rest position so as to strike against said heel of said needles that are situated at said first level in such a manner as to raise said needles to a third level, higher than said second level, where the knit stitch is made, while the eighth cam downstream strikes against said heels of said needles that are being lowered and drops lower than the rest position of said needles, in such a manner as to control the density of the fabric; two ninth cams that move, perpendicularly to the plane of said carriage, from an idle position to a work position and vice versa, said cams being symmetrical about said vertical plane of symmetry of said two groups of cams, and located above and correspondently in series in relation to said eighth cams, such that the ninth cam that is upstream, when it is in work position, strikes against the heel of said needles located at said third level and raises the needles to a fourth level where the knit stitch can be transferred to another needle bed, and such that the ninth cam that is downstream is kept permanently in work position and not only operates in combination with a tenth cam, that is pivoted about an axis perpendicular to the plane of said carriage and co-planar with said vertical plane of symmetry of said two groups of cams, to transfer the heels of said needle located at said fourth level towards said downstream eighth cam, but also operates to convey towards said eighth cam the heels of said needles located at the third level; an eleventh cam, that moves perpendicularly to the plane of said carriage from an idle position to a work position and vice versa, said eleventh cam being centred in relation to said vertical plane of symmetry of said two groups of cams and designed, when it is in work position, to strike against said needle heels that are in said rest position in such a manner as to raise the latter to said second level; two twelfth cams, that move perpendicularly to said plane of said carriage from an idle position to a work position, located on either side of said eleventh cam, the twelfth cam that is upstream, when it is in work position, operating to guide said needle heels while the latter are lifted, either by said fifth and sixth cams or by said eleventh cam, from rest position to said second level, while the twelfth cam that is downstream, when it is in work position, strikes against said needle heels in such a manner as to move them from said second level to the relative rest position; two fixed thirteenth cams, located correspondently above said groups of cams symmetrically about said plane of symmetry of said groups and below said seventh cams, each of said thirteenth cams being designed to strike against said first heel of said sinkers that are located at a point between said second and third intermediate positions and selected by said group of cams located upstream of said thirteenth cam, in such a manner as to raise said sinkers to said third intermediate position.

2. A device according to claim 1 wherein said second cams have both outer faces and inner faces sloping and divergent, in top to bottom direction, from said vertical plane of symmetry of said two groups of cams, and wherein said third cams have outer faces that are coplanar with corresponding outer faces of said second cams and inner faces that are inclined similarly to corresponding inner faces of said second cams but further in than the latter.

3. A device according to claim 1 wherein said eighth cams have a concavity in their top face.

4. A device according to claim 1 wherein said ninth cams have a concavity in their top face which engages with said heels of said needles located at said fourth level.

5. A device according to claim 1 wherein there are two fixed cams one on each side of the outer face of said second and third cams, with each of said fixed cams having its inner face sloping at the same angle as the outer face of said second and third cams in such a way as to guide said first heels of said sinkers engaged by one or both of the opposite outer faces of said second and third cams.

6. A device according to claim 1 wherein there are two fixed cams one on each side of the outer face of said eighth cams, with each of said fixed cams having its inner face sloping at the same angle as the outer face of said eighth cams in such a way as to form a guide for said heels of said needles as they are lifted from said first to said third level.

7. A device according to claim 4 wherein there is a fixed cam located above said ninth movable cams, a bottom face of which is the same in shape as the opposing top faces of said movable cams in such way as to guide said heels of said needles located at said fourth level.

8. A device according to claim 1 wherein said twelfth cams when in working position, form an overturned "V" identical to said race made by said fifth and sixth cams, with the vertical distance between said "V" and said race being the same as the distance between said heel of said needle and said first heel of the associated sinker when said sinker and needle are side by side.

* * * * *